US007699580B2

(12) United States Patent
Lasko et al.

(10) Patent No.: US 7,699,580 B2
(45) Date of Patent: Apr. 20, 2010

(54) PORTABLE AIR MOVING DEVICE

(75) Inventors: William E. Lasko, Chester Springs, PA (US); Paul W. Orr, Coatsville, PA (US)

(73) Assignee: Lasko Holdings, Inc., Wilmington, DE (US)

( * ) Notice: Subject to any disclaimer, the term of this patent is extended or adjusted under 35 U.S.C. 154(b) by 216 days.

(21) Appl. No.: 10/944,290

(22) Filed: Sep. 16, 2004

(65) Prior Publication Data

US 2005/0031448 A1 Feb. 10, 2005

Related U.S. Application Data

(63) Continuation-in-part of application No. 10/347,079, filed on Jan. 17, 2003, now abandoned, which is a continuation-in-part of application No. 10/322,169, filed on Dec. 18, 2002, now Pat. No. 6,760,543.

(51) Int. Cl.
*F04D 29/48* (2006.01)

(52) U.S. Cl. ..... 415/98; 415/53.1; 415/102; 415/121.3; 415/125; 415/126; 415/204; 415/206; 416/100; 416/146 R; 416/247 R

(58) Field of Classification Search ..... 415/53.1, 415/53.2, 53.3, 98, 102, 121.3, 125–128, 415/204, 206, 211.2, 213.1; 416/100, 146 R, 416/246, 247 R See application file for complete search history.

(56) References Cited

U.S. PATENT DOCUMENTS 1,429,130 A 9/1922 Dutton
2,255,759 A 9/1941 Carpenter
2,471,784 A 5/1949 Seifner et al.
2,544,281 A * 3/1951 Seil ..... 416/247 R
2,824,429 A 2/1958 Zucker
3,175,550 A 3/1965 Knapp
3,251,540 A 5/1966 Kinsworthy
3,267,255 A 8/1966 Schultz
3,290,112 A 12/1966 Gillenwater et al.
3,575,582 A 4/1971 Covault
3,725,640 A 4/1973 Kunz
4,743,739 A 5/1988 Tateishi
4,856,968 A * 8/1989 Armbruster ..... 415/126
4,900,898 A 2/1990 Kling
5,083,011 A 1/1992 Munroe
5,266,004 A * 11/1993 Tsumurai et al. ..... 416/100
5,342,175 A * 8/1994 Patton ..... 416/247 R
6,079,949 A 6/2000 Litvin
6,120,248 A * 9/2000 Litvin et al. ..... 416/247 R
6,321,034 B2 11/2001 Jones-Lawlor et al.

(Continued)

FOREIGN PATENT DOCUMENTS

DE 863 112 1/1953

(Continued)

*Primary Examiner*—Christopher Verdier
(74) *Attorney, Agent, or Firm*—Pepper Hamilton LLP

(57) ABSTRACT

A stable portable air moving device capable of generating an air stream elevated above a support surface allowing the air stream to be directed as desired by the user is provided. The device includes an air blower assembly located within an elongate housing generating an exhaust air stream that exits the elongate housing at an elevation above the air blower assembly.

61 Claims, 5 Drawing Sheets

U.S. PATENT DOCUMENTS

| | | | | |
|---|---|---|---|---|
| RE37,642 | E | 4/2002 | Goldstein | |
| 6,480,672 | B1 | 11/2002 | Rosenzweig et al. | |
| 6,669,556 | B2 * | 12/2003 | Gautney | 454/338 |
| 6,997,680 | B2 * | 2/2006 | Shapiro et al. | 416/100 |

FOREIGN PATENT DOCUMENTS

| | | | | | |
|---|---|---|---|---|---|
| EP | 0 417 309 | A1 | | 3/1991 | |
| FR | 993 168 | | | 10/1951 | |
| FR | 1 502 108 | | | 11/1967 | |
| GB | 2185531 | A | * | 7/1987 | 415/125 |
| JP | 1-113598 | A | * | 5/1989 | 416/246 |

* cited by examiner

PORTABLE AIR MOVING DEVICE

CROSS-REFERENCE APPLICATIONS

This application is a Continuation-in-Part of application Ser. No. 10/347,079, filed Jan. 17, 2003, now abandoned, which is a Continuation-in-Part of application Ser. No. 10/322,169, filed Dec. 18, 2002, now U.S. Pat. No. 6,760,543.

FIELD OF THE INVENTION

This invention relates generally to fans. More specifically, the present invention relates to portable high velocity fans.

BACKGROUND OF THE INVENTION

High velocity air moving devices have been utilized for many years. One example of a conventional device includes an axial fan blade type impeller and a motor. These types of devices not only produce a high velocity air stream but also produce a large volume of air movement. A disadvantage of this device is that the axial fan blade is large and requires even larger protective grills. Another disadvantage of this device is that the large volumes of air combined with the high velocity of the air stream produce a large thrust. The thrust must be counteracted by utilizing a large base to stabilize the device. The thrust stability problem can be exacerbated if the device is elevated above its support surface. The large components (blades and protective grills) of axial fans along with the increased thrust and corresponding stability problems do not allow these types of devices to be easily transportable (portable) or to have space saving characteristics.

Another disadvantage of these conventional devices is that the high volume of air that is moved by the device may not be desirable. The high volume of air may cause objects, (such as papers for example) to be dislodged from their intended place. Further, the large volume of air increases the possibility that dust, pollen, dander, etc. will be disturbed and induced to become airborne. The airborne dust and debris can be detrimental to, for example, respiratory conditions.

SUMMARY OF THE INVENTION

In light of the shortcomings of the prior art, the present invention is directed to a high velocity air movement device that produces an air steam of sufficient velocity to maximize the evaporation of moisture (sweat) from the skin of the user. This can be achieved in that the velocity of the air stream allows it to efficiently impinge the surface (skin) of the user and rapidly evaporate the moisture. One manner to enhance this effect is to raise the elevation of the high velocity air stream, thus allowing the air stream to impinge on the user's upper body. The upper body is more exposed and therefore will experience the effects of the cooling more quickly.

In another embodiment of the invention, a high velocity air moving device allows a user to have the ability to direct and focus the air stream to a desired location. This helps to alleviate or lessen the disturbance of other objects in the area as mentioned, while allowing the user to experience the cooling advantages of a high velocity air moving device According to one aspect of the invention, the device is free standing comprising a base engaging a support surface.

According to another aspect of the invention, the device comprises an elongate housing extending substantially upward, and an interior space defined by the elongate housing.

According to another aspect of the invention, there is at least one air inlet in the elongate housing allowing intake air to enter, and an air outlet located in an upper portion of said elongate housing.

According to yet another aspect of the invention, an air blower assembly is disposed within the elongate housing. The air blower assembly includes at least one air impeller disposed within an impeller casing and at least one motor rotating the impeller.

According to another aspect of the invention, an exhaust air stream generated by the air blower assembly exits the interior space at an elevation above the air blower assembly.

According to another aspect of the invention, the air blower assembly is disposed within a lower portion of the interior space of the elongate housing.

According to another aspect of the invention, a maximum velocity of the exhaust air stream measured about 8 feet from the air outlet is between about 750 feet per minute to about 2000 feet per minute.

According to yet another aspect of the invention, a maximum thrust in a direction opposite to a direction the flow of the exhaust air stream exiting the air outlet is about 1.0 pound of force or less.

According to another aspect of the invention, a velocity to thrust ratio, defined as a maximum velocity of the exhaust air stream measured about 8 feet from the air outlet divided by a maximum thrust generated by the exhaust air stream in a direction opposite to the direction of the flow of the exhaust air stream is about 500:1 or greater.

According to another aspect of the invention, a longitudinal length of the elongate housing is substantially orthogonal to an axis of rotation of the impeller of the air blower assembly.

According to another aspect of the invention, the elongate housing has an elongated aspect ratio that is about 2 to 1 or greater. The elongated aspect ratio defined as the longitudinal length of the elongate housing being greater than a width of the elongate housing.

According to another aspect of the invention, the base is a unitary part of the elongate housing.

According to another aspect of the invention, the base is rotatably coupled to the elongate housing.

According to another aspect of the invention, the motor is a variable speed motor having one or more rotational speeds that are controlled by a control assembly.

BRIEF DESCRIPTION OF THE DRAWINGS

The invention is best understood from the following detailed description when read in connection with the accompanying drawing. It is emphasized that, according to common practice, various features of the drawings are not to scale. On the contrary, the dimensions of various features are arbitrarily expanded or reduced for clarity. Included in the drawings are the following Figures.

DETAILED DESCRIPTION OF ILLUSTRATIVE EMBODIMENTS

The following description is of a portable air moving device that generates a focused stream of high velocity air that is easily directed by the user to a desired location. The device also has a vertical aspect ratio relative to a support surface, which allows the generated air stream to affect the user's upper body more readily. The device also has space saving characteristics. In addition, the high velocity air moving device is preferably portable and can be easily moved by the user to a desired location. The air blower assembly of the device uses an air generator having an impeller and motor design that is relatively inexpensive to manufacture. In other embodiments, the high velocity air moving device provides various combinations of the above characteristics at a desirable retail cost for the consumer.

Figure 1:
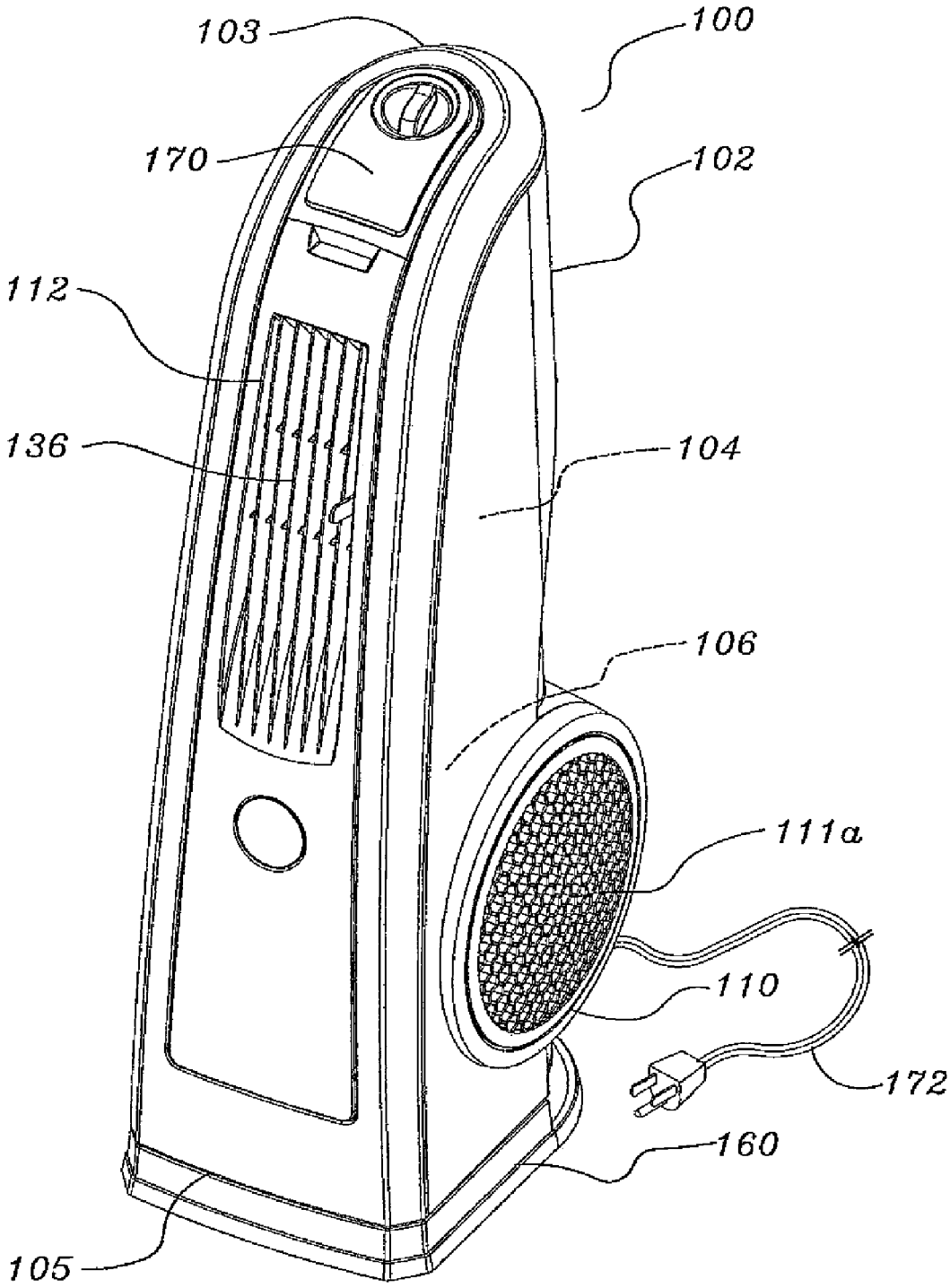
FIG. 1 is a perspective view of an exemplary embodiment of the present invention.

FIG. 1 shows an exemplary perspective view of portable air moving device 100. Portable air moving device 100 includes housing 102 having at least one side wall extending between top 103 and lower end 105. Portable air moving device 100 includes base 160 for engaging a support surface (not shown). Base 160 can be formed integral with housing 102 or as a separate piece that is connected to a lower end 105 of housing 102. Housing 102 defines interior space 104. Disposed within interior space 104 is air blower assembly 106.

In one exemplary embodiment housing 102 is an elongate housing having a vertical aspect ratio. The vertical aspect ratio of housing 102 being defined as the vertical height of housing 102 being greater than a horizontal width of housing 102. In one embodiment the vertical aspect ratio of elongate housing 102 is greater than 2 to 1. In a preferred embodiment elongate housing 102 has a vertical aspect ratio of 3 to 1 or greater.

Portable air moving device 100 includes at least one air inlet 110 and at least one air outlet 112. As shown in FIG. 1, air inlet 110 is preferably located in a lower portion of housing 102 and air outlet 112 is located in an upper portion of housing 102 at an elevation above a support surface. Preferably inlet grill 111*a* is provided over air inlet 110 and outlet grill 136 is provided over air outlet 112. Outlet grill 136 may include louvers that are positionable for directing a flow of exhaust air exiting air outlet 112. In one exemplary embodiment air outlet 112 is an elongate air outlet having a vertical aspect ratio. The vertical aspect ratio of air outlet 112 being defined as the vertical height of air outlet 112 being greater than a horizontal width of air outlet 112. In one preferred embodiment the vertical aspect ratio of elongate air outlet 112 is greater than 1.5 to 1. In another embodiment, the vertical aspect ration of elongate air outlet 112 is at least 1.5:1.

Portable air moving device 100 also includes at least one control assembly 170. Control assembly 170 controls a function of portable air moving device 100. Also shown is power cord 172, utilized to connect portable air moving device 100 to an electrical power source (i.e. wall outlet). The electrical component connections of portable air moving device 100 are integrated within the device, such as for example between control assembly 170 and blower assembly 106. The integration of the electrical component connections within the device eliminates the need for user to make such connections. In the exemplary embodiment shown, for example only the connection of power cord 172 to an electrical power source is required. The integration of the electrical component connections within the device also enhance the portability of portable air moving device 100.

Figure 2:
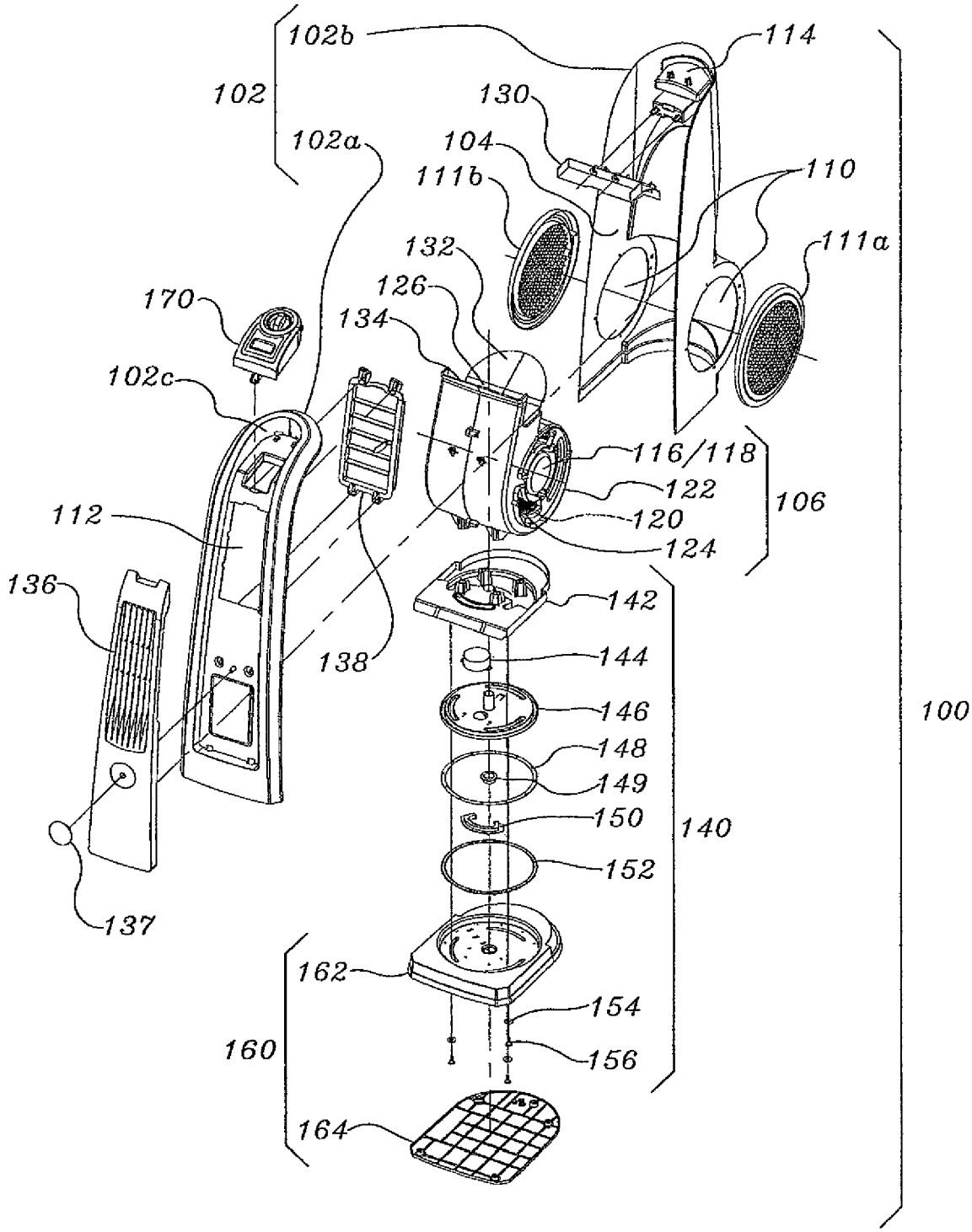
FIG. 2 is an exploded view of the exemplary embodiment of FIG. 1.

FIG. 2 shows an exploded perspective view of portable air moving device 100. As shown in FIG. 2, housing 102 may be constructed of more than one component, such as, for example, two halves 102*a* and 102*b* that are assembled together. Housing 102 has at least one air inlet 110 and one air outlet 112. Housing 102 defines interior space 104.

Housing 102 also includes handle 114. Handle 114 is used to increase the convenience of portability of the device. It is contemplated that handle 114 may be an integral part of housing 102 as shown or, for example a separate piece or pieces, (not shown) attached to portable air moving device 100.

Disposed within interior space 104 is air blower assembly 106. Air blower assembly 106 includes motor 116 and at least one air impeller 120 connected to motor shaft 118. In one embodiment, motor 116 is a permanent split capacitor (PSC) motor. In another embodiment, motor 116 is a permanent split capacitor motor and totally enclosed non-ventilated electric motor. Air blower assembly 106 may also include, as in this example, impeller casing 122 and other components, (not shown). The use of air blower assembly 106 allows motor shaft 118 to support impeller 120 without the use of extra external bearings, (not shown). The use of air blower assembly 106 allows for the pre-assembly and pre-testing of air blower assembly 106 thereby allowing the manufacture and assembly of portable air moving device 100 to be less costly when compared to assembling motor 116, air impeller 120 and impeller casing 122 into the device as separate components. In this example the air blower assembly 106 is a dual intake centrifugal type blower.

Air blower assembly 106 also includes at least one intake port 124 and at least one exhaust port 126. Ambient air is drawn into intake port 124 by the rotation of air impeller 120. A high velocity air stream exits air blower assembly 106 through exhaust port 126.

Also disposed within interior space 104 in this example is air directing component 130 and air segregation walls 132 and 134. Air directing component 130 assures that the high velocity air stream generated by air blower assembly 106 is efficiently directed toward air outlet 112 of housing 102. The air segregation wall can be formed as one or more air segregation walls, such as air segregation walls 132 and 134 shown in FIG. 2. One or more air segregation walls 132 and 134 substantially prevent the recirculation of the high velocity air stream between exhaust port 126 and intake port 124 of air blower assembly 106. One or more air segregation walls 132 and 134 assure that substantially all of the high velocity air stream is expelled through air outlet 112 of housing 102 and does not recirculate within interior space 104. Air directing component 130 and one or more air segregation walls 132 and 134 may be separate pieces or of unitary construction integral with other parts of portable air moving device 100 such as, for example, housing 102 or air blower assembly 106.

Preferably, protective grill 136 is located proximate air outlet 112. Protective grill 136 is designed to minimize impedance of the high velocity air flow as it exits portable air moving device 100 while at the same time protecting portable air moving device 100 from the penetration of foreign objects into interior space 104. Incorporated with protective grill 136 may be air directing devices, such as adjustable louvers 138, for example. Adjustable louvers 138 allow additional directional control capabilities of the high velocity air stream.

Protective grill 136 may be attached to housing 102 through an assembly device, (not shown), such as for example; screws, adhesives or snaps. Protective grill 136 may include at least one ornamental cover 137 to hide the assembly device, (not shown).

Intake grills 111*a* and 111*b* are preferably located proximate at least one air inlet 110. Intake grills 111*a* and 111*b* are designed to minimize their impedance to the flow of air into portable air moving device 100 while at the same time protecting portable air moving device 100 from the penetration of foreign objects into interior space 104.

In one exemplary embodiment, housing 102 rotates with respect to a support surface. As shown in the exemplary embodiment the axis of rotation of housing 102 is substantially parallel with the longitudinal length of housing 102. Such rotation may be accomplished either in an oscillatory fashion, a stepwise positioning of housing 102 (either manually or under automated control), or in a constant rotation, either in a clockwise or counter-clockwise direction. In one example the rotational range of housing 102 is between about 0 degrees and about 360 degrees. In another exemplary embodiment the rotational range is between about 0 degrees and 90 degrees.

FIG. 2 also shows oscillating mechanism 140. Oscillating mechanism 140 moves housing 102 of portable air moving device 100 through an oscillation movement. The oscillation movement allows the high velocity air stream to be dispersed over a larger area if desired. Oscillating mechanism 140, in this example, is comprised of oscillation plate 142, oscillation motor 144, motor plate 146, upper thrust bearing 148, radial bearing 149, gear 150, lower thrust bearing 152, washers 154 and oscillation shoulder screws 156. It is contemplated that other oscillating mechanisms, such as a link and pivot design, may be used to achieve oscillation movement.

Base 160 engages a support surface thus allowing the entire structure of portable air moving device 100 to be positioned in a substantially vertical and upright position. Such a base 160 may be either fixed or rotatably coupled to housing 102. Base 160 may be comprised of one or multiple pieces attached to one another, such as for example base top 162 and base bottom 164. Base 160 may be made of materials such as metals or polymers or a combination of various materials.

Although the exemplary embodiment shown in FIG. 2 illustrates base 160 and housing 102 as separate pieces, the invention is not so limited. It is contemplated that the support of housing 102 may be accomplished in a variety of ways, such as forming base 160 as a unitary member having a variety of predetermined shapes.

In one embodiment, base 160 can be uncoupled from housing 102. Base 160 can then be stored along with housing 102 and all other components of portable air moving device 100 to economize space. The space economization for storing portable air moving device 100 can be used for shipping purposes thus allowing more units in a given transport container (i.e. truck) and thereby reducing the overall cost per unit for transportation.

Control assembly 170 is used to control a function of portable air moving device 100 such as for example, the speed of air blower assembly 106 and/or rotation or oscillation of the device. In one embodiment as shown in FIG. 2 control assembly 170 is mounted to area 102*c* of housing 102. The position of control assembly 170 on the substantially vertical and upright structure of portable air moving device 100 also benefits the user in that the height of control assembly 170 above a support surface (floor) allows convenient accessibility for visual inspection and manual adjustment of the controlled functions. Alternatively, a remote control unit (not shown) may accomplish the control of portable air moving device 100 in conjunction with, and/or as a replacement for control assembly 170.

It is contemplated that portable air moving device 100 may be constructed with material such as polymers, sealed motors, sealed switches and other components, such as for example rain sensors that could optimize a weather proof construction. This would facilitate the use of portable air moving device 100 on decks, boats and other areas that might be exposed to varying weather conditions.

Figure 3B:
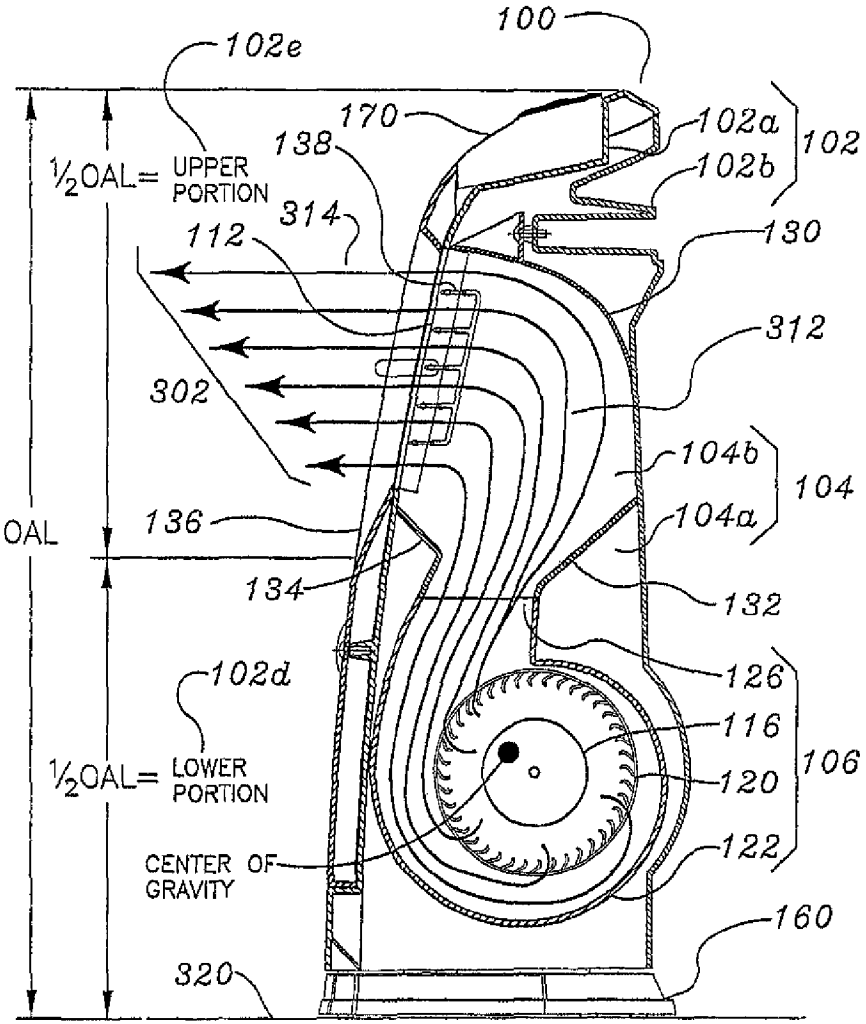
FIGS. 3A and 3B illustrate the air flow pattern into, through, and exiting the exemplary embodiment of FIG. 1.
Figure 3A:
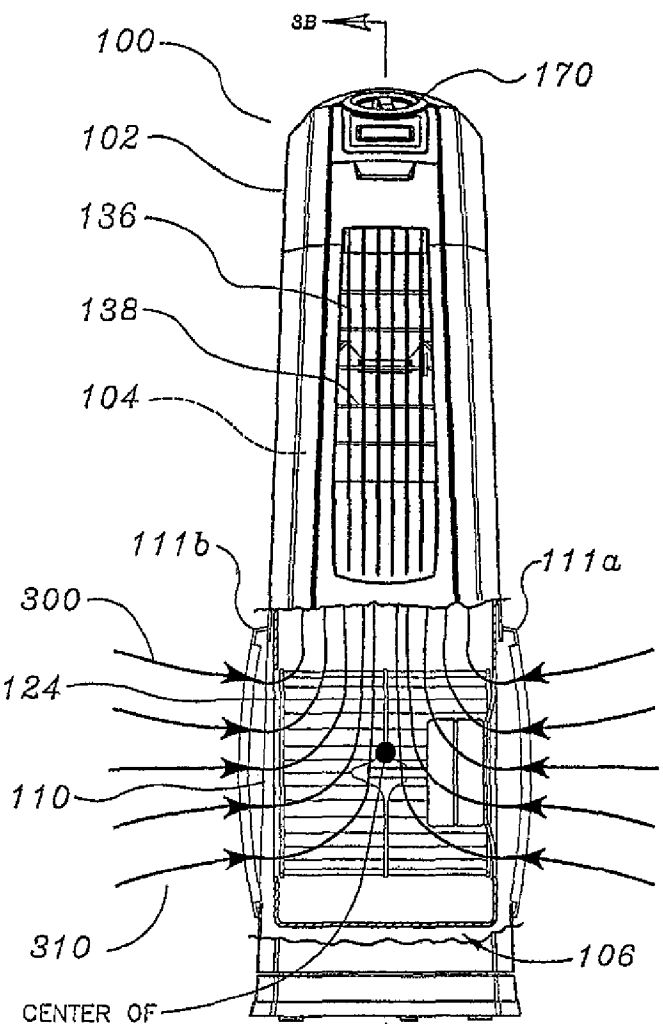

FIGS. 3A and 3B show a partial front view and a cross sectional view of an exemplary embodiment of portable air moving device 100. Illustrated is the flow of air into, though, and out of portable air moving device 100. The rotation of motor 116 causes air impeller 120 to rotate inducing intake air 300 into interior space 104 of housing 102 through at least one air inlet 110. Intake air 300 enters air blower assembly 106 through at least one intake port 124 and is accelerated by impeller 120 and exits air blower assembly 106 through exhaust port 126 as high velocity exhaust air stream 302. High velocity exhaust air stream 302 passes through interior space 104 of housing 102, which in this example is oriented substantially vertically, and exits housing 102 of portable air moving device 100 through at least one air outlet 112.

As shown in FIG. 3A, intake air 300 may enter housing 102 through two air inlets 110 located on opposite sides of air blower assembly 106. Intake air 300 enters the air blower assembly through two air inlet ports 124 on opposite sides of the air blower assembly 106. As shown in the exemplary embodiment, inlet ports 124 are substantially concentric with air inlets 110. Although shown having a single air exhaust port 126, air blower assembly 106 may also include more than one air exhaust port 126 that discharge high velocity exhaust air stream 302 from air blower assembly 106 into one or more air outlet passageways 104*b*.

High velocity exhaust air stream 302 is directed through interior space 104 of housing 102 by at least one air directing component 130. Air segregation walls 132 and 134 impede fluid communication and substantially reduces the recirculation of high velocity exhaust air stream 302 between exhaust port 126 and intake port 124 of air blower assembly 106. Air segregation walls 132 and 134 divide interior space 104 of housing 102 into air inlet passageway (intake portion) 104*a* and air outlet passageway (exhaust portion) 104*b*. The division of interior space 104 of housing 102 as described aids the velocity conservation of high velocity exhaust air stream 302 by substantially reducing the possibility of air recirculation within housing 102 of portable air moving device 100.

In the embodiment shown in FIGS. 3A and 3B, intake air 300 enters interior space 104 along a first flow path 310. High velocity exhaust air stream 302 exits air blower assembly 106 along a second flow path 312. High velocity exhaust air stream 302 exits portable air moving device 100 along a third flow path 314. In the exemplary embodiment shown, first flow path 310 is substantially orthogonal to second flow path 312, and second flow path 312 is substantially orthogonal to third flow path 314. In one embodiment, third flow path 314 is substantially orthogonal to first flow path 310. Air directing component 130 assures that high velocity exhaust air stream 302 transitions smoothly from second flow path 312 to third flow path 314. The substantially smooth transition from second flow path 312 to third flow path 314 helps to maintain the desired air flow velocity of high velocity exhaust air stream 302. In one embodiment third flow path 314 is substantially parallel to support surface 320 allowing high velocity exhaust air stream 302 to project away from portable air moving device 100 and toward a desired location. The projection of high velocity exhaust air stream 302 away from portable air moving device 100 reduces the recirculation of high velocity exhaust air stream 302 between air outlet 112 and air inlet 110.

The flow of air into, though, and out of portable air moving device 100 as described allow high velocity exhaust air stream 302 to exit portable air moving device 100 through air outlet 112 located in upper portion 102*e* of housing 102 above air blower assembly 106 and thus be elevated above support surface 320. (Upper portion 102*e* of housing 102 is defined by the upper half of the overall length "OAL" of portable air moving device 100). In one embodiment blower assembly 106 may be located in upper portion 102*e* of housing 102. As shown air blower assembly 106 is located in lower portion 102*d* of housing 102 allowing the mass of air blower assembly 106 to be located closer to support surface 320. The location of the mass of air blower assembly 106 in lower portion 102*d* as described relative to support surface 320 increases the stability of portable air moving device 100 and minimizes the size of base 160, thus maximizing space saving characteristics of portable air moving device 100 while allowing the elevation of air outlet 112 of housing 102 above support surface 320.

In one embodiment the center of gravity of portable air moving device 100 is located within lower portion 102*d* of housing 102.

Another advantage to air flow paths 310, 312 and 314 as illustrated by FIGS. 3A and 3B is that the location of air impeller 120 is not proximate air outlet 112. The location and distance of air outlet 112 from air impeller 120 increases the safety of portable air moving device 100. This distance decreases the possibility that a foreign object, (not shown) can contact air impeller 120 when inserted into interior space 104 through air outlet 112. This distance combined with protective grill 136 located proximate air outlet 112, protects air impeller 120 from damage and the user of portable air moving device 100 from possible injury. In one example, the distance from a furthest extent of air outlet 112 to air impeller 120 is greater than one diameter of air impeller 120.

Figure 4B:
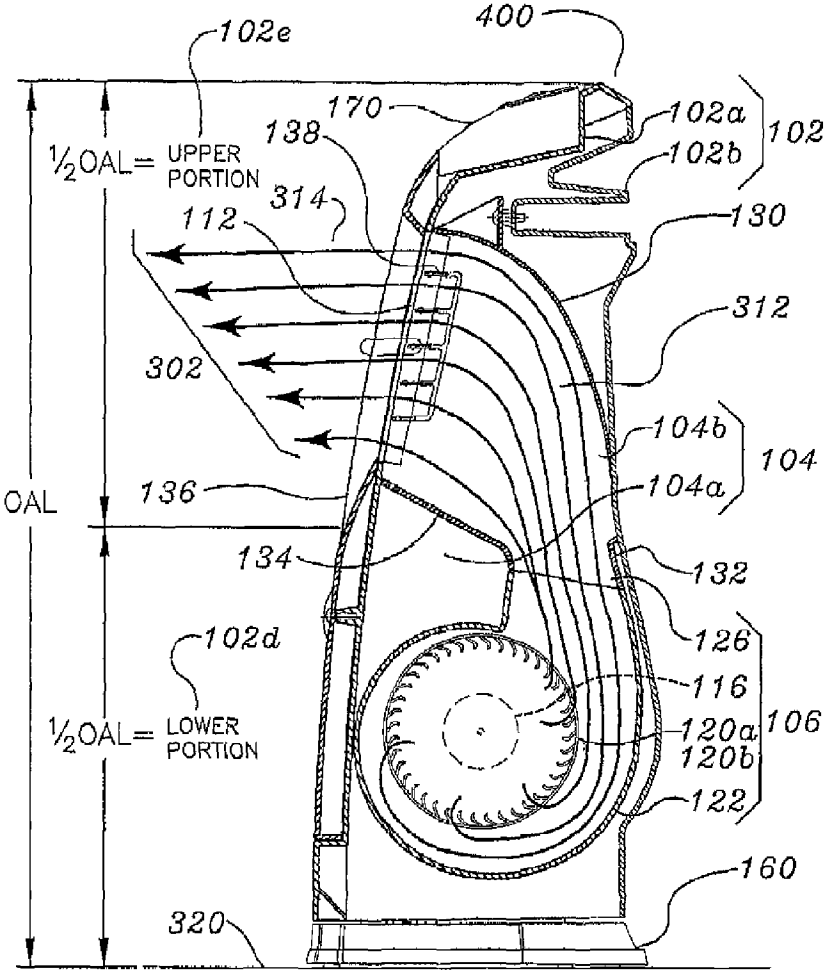
FIGS. 4A and 4B illustrate the air flow pattern into, through, and exiting another embodiment of the present invention.
Figure 4A:
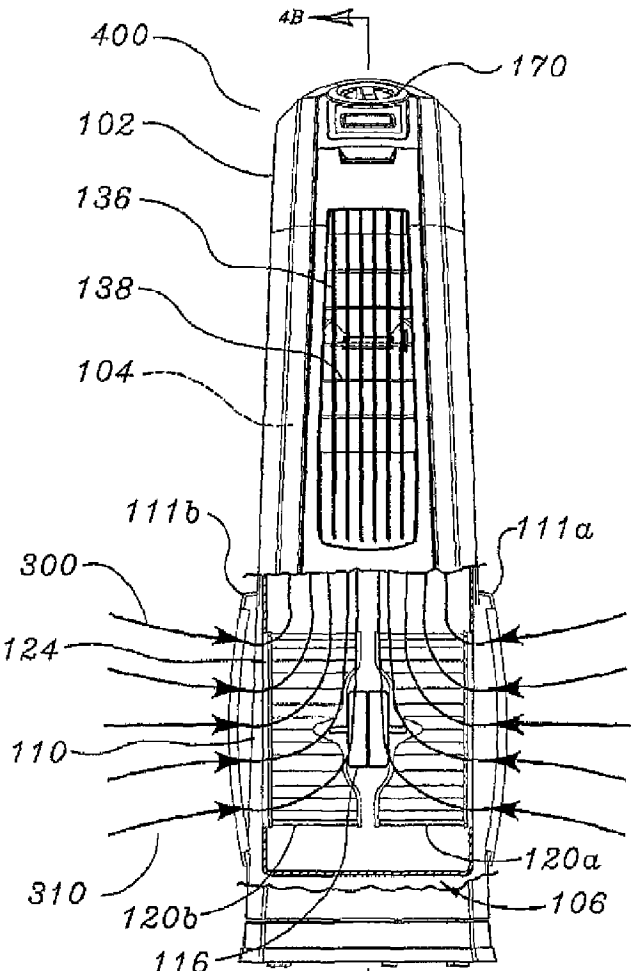

FIGS. 4A and 4B show a partial front view and a cross sectional view of another exemplary embodiment of portable air moving device 400. Illustrated is the flow of air into, though, and out of portable air moving device 400. The rotation of motor 116 causes air impeller 120 to rotate inducing intake air 300 into interior space 104 of housing 102 through at least one -air inlet 110. Intake air 300 enters air blower assembly 106 through at least one intake port 124 and is accelerated by impeller 120 and exits air blower assembly 106 through exhaust port 126 as high velocity exhaust air stream 302. High velocity exhaust air stream 302 passes through interior space 104 of housing 102, which in this example is oriented substantially vertically, and exits housing 102 of portable air moving device 400 through at least one air outlet 112. As shown in FIG. 4A the embodiment of blower assembly 106 may incorporate two air impellers 120*a* and 120*b* located on opposing sides of motor 116.

As shown in FIG. 4B, blower assembly 106 projects high velocity exhaust air stream 302 through exhaust port 126 along second flow path 312. Blower assembly 106 is oriented within portable air moving device 400 so as to direct second flow path 312 substantially toward air outlet 112. Air directing component 130, as shown in this example has a long curve allowing an efficient transition from second flow path 312 to third flow path 314. The characteristics of projecting second flow path 312 more directly toward air outlet 112 combined with the long curve of air directing component 130 improves the conservation of velocity of high velocity exhaust air stream 302 when compared to the previous exemplary embodiment of FIGS. 3A and 3B.

Figure 5A:
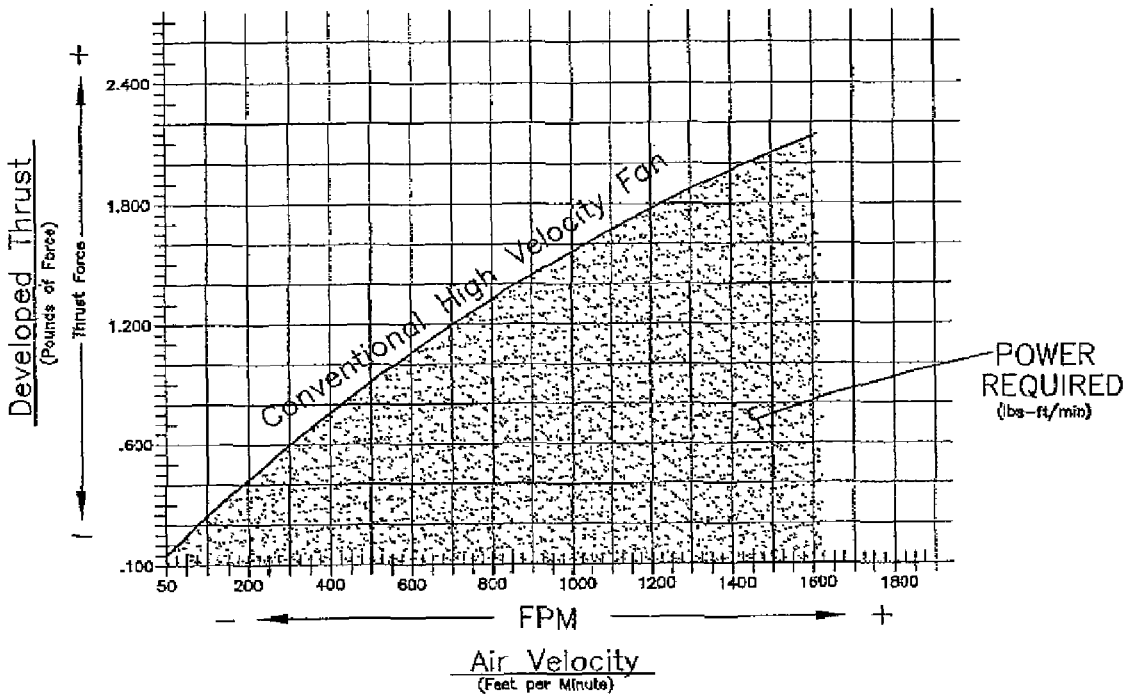
FIGS. 5A and 5B illustrate two graphs that compare the thrust characteristic of a conventional high velocity fan and an embodiment of the portable air moving device in accordance with the present invention.
Figure 5B:
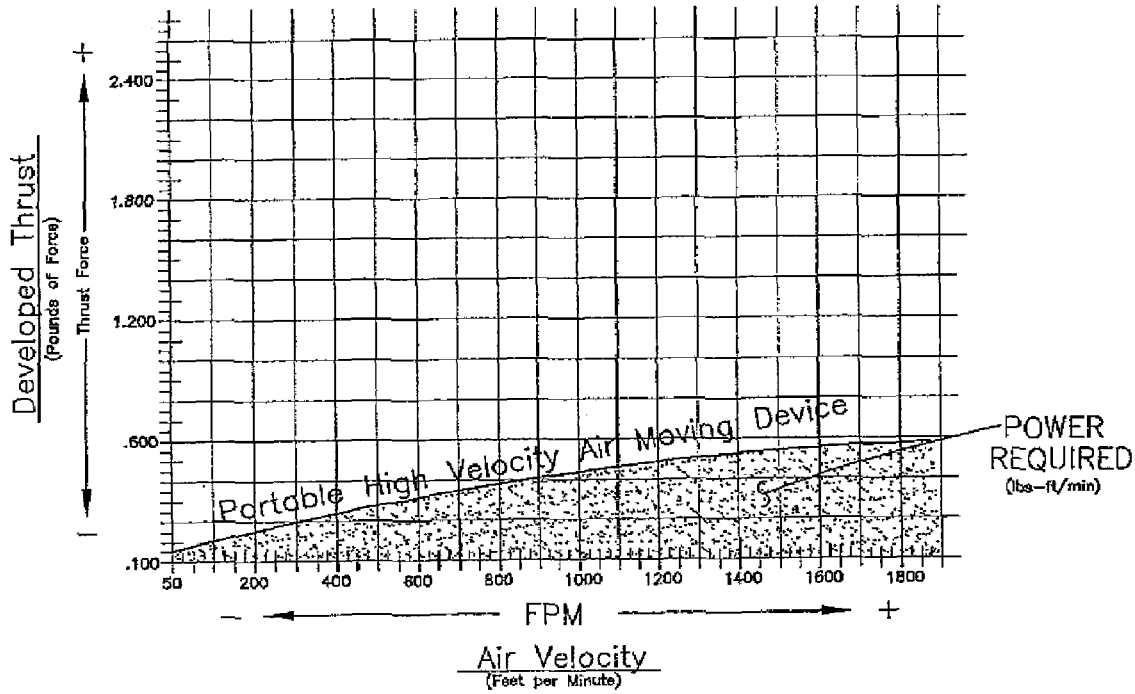

In other respects the preferred exemplary embodiment of FIGS. 4A and 4B is similar to the description of the embodiment shown in FIGS. 3A and 3B FIGS. 5A and 5B compare the thrust characteristics of a conventional high velocity fan and the portable air moving device of the present invention. FIG. 5A shows air velocity in feet per minute versus the thrust developed in pound for a conventional high velocity fan. The shaded area under the curve is the required power from the motor of a conventional high velocity fan in lbs-ft per minute. The shaded area below the curve is also indicative of the air volume generated by a conventional high velocity fan. FIG. 5B shows air velocity in feet per minute versus the thrust developed in pound for a portable high velocity air moving device in accordance with one exemplary embodiment of the present invention. The shaded area under the curve is the required power from the motor of the portable high velocity air moving device in lbs-ft per minute. The shaded area below the curve is also indicative of the air volume generated by the portable high velocity air moving device.

As shown in FIGS. 5A and 5B, air blower assembly 106 of portable air moving device 100 is designed to optimize the desired characteristics of achieving a high air velocity exiting portable air moving device 100 while minimizing the thrust created by the high velocity air stream. Maintaining the velocity at a high level maximizes the cooling effect for the user. Minimizing or limiting the thrust reduces its destabilizing effects on portable air moving device 100. Thrust is the force that is generated in a direction substantially opposite the flow of high velocity exhaust air stream 302 along air path 314 as it exits air outlet 112, as shown in FIGS. 3A, 3B and 4A, 4B. To remain stable and in an upright position, portable air moving device 100 must counteract this force of thrust. One method of counteracting the force of thrust is to increase the size of base 160 of portable air moving device 100. Minimizing or limiting the thrust reduces its destabilizing effects and in-turn reduces the need for a large base. Reducing the need of a large base facilitates possible space saving characteristics while allowing an elevated air outlet 112 for the high velocity air stream. The ability of blower assembly 106 to generate a low volume of air with a high velocity achieves the desired low thrust characteristics for exhaust air stream 302. In one embodiment blower assembly 106 is a centrifugal blower. Centrifugal blowers are able to generate the desired low volume high velocity air streams.

Another advantage to the minimization of thrust is that motor 116 of the air blower assembly 106 does not require the power that would be needed to move a greater volume of air. This allows the needed motor torque to be reduced and decreases the heat generated by the motor. The motor can therefore utilize fewer materials and be less expensive while yet producing the required air stream velocity. This in turn yields cost savings for the manufacturer and the consumer.

In one exemplary embodiment high velocity exhaust air stream 302 has a maximum velocity of about 500 feet per minute or greater when measured at a distance of about 8 feet from air outlet 112 of portable air moving device 100. In a preferred embodiment the maximum velocity of high velocity exhaust air stream 302 is greater than 1000 feet per minute when measured 8 feet from air outlet 112. In another embodiment the maximum velocity of high velocity exhaust air stream 302 is between 750 feet per minute and 2000 feet per minute. The maximum velocity of exhaust air stream 302 is measured by locating an anemometer 8 feet from air outlet 112 of portable air moving device 100. The anemometer is moved vertically up and down and horizontally while maintaining the 8 feet of distance until the maximum velocity within exhaust air stream 302 is located. In another exemplary embodiment the maximum thrust generated in a direction opposite the direction of the flow of air path 314 of high velocity exhaust air stream 302 is about 1.0 lbs or less. In one embodiment the maximum thrust is less than 0.7 lbs. The maximum thrust is measured using a certified thrust table as specified by AMCA (Air Movement and Control Association). In another exemplary embodiment the ratio of the maximum velocity of high velocity exhaust air stream 302 measured at a distance of about 8 feet from air outlet 112 divided by the maximum thrust generated in a direction opposite to the direction of the flow of air path 314 of the high velocity exhaust air stream 302 is about 500:1 or greater.

As described the preferred embodiment of portable air moving device 100 uses air blower assembly 106, (having the proper volume and velocity characteristics) to generate a high velocity low thrust exhaust air stream 302. Low thrust permits exhaust air stream 302 to be elevated above a support surface without compromising the stability of portable air moving device 100. Preferably the location of air blower assembly 106 is in a lower portion of housing 102, thus allowing the mass of air blower assembly 106 to remain closer to the support surface. The location of air blower assembly 106 as described further enhances the stability of portable air moving device 100. Housing 102 in conjunction with air directing component 130 and air segregation walls 132 and 134 conserve the velocity of exhaust air stream 302 as it is elevated above the support surface while passing through interior space 104 of housing 102. As a result the preferred embodiment of portable air moving device 100 supplies exhaust air stream 302 elevated above a support surface, allowing the generated air stream to more readily affect the user's upper body. As described the velocities of exhaust air stream 302 are sufficient to impinge upon the user and further enhance the cooling sensation. The enhanced stability of portable air moving device 100 as described allow the size of base 160 to be minimized to further contribute to space saving characteristics.

Although the invention has been described with reference to exemplary embodiments, it is not limited thereto. Rather, the appended claims should be construed to include other variants and embodiments of the invention, which may be made by those skilled in the art without departing from the true spirit and scope of the present invention.

What is claimed:

1. A portable air moving device that is free standing on a support surface, said device comprising:

a base for engaging said support surface;

an elongate housing having a longitudinal length extending substantially upward from said base;

an interior space defined by said elongate housing;

an overall vertical length of said portable air moving device comprising:

an upper portion defined by the upper half of said overall vertical length;

a lower portion defined by a lower half of said overall vertical length;

at least one air inlet in said elongate housing allowing intake air to enter said interior space;

an air blower assembly disposed substantially within said lower portion of said overall vertical length and within said interior space, said air blower assembly comprising:

an air impeller;

a motor for rotating said air impeller about an axis of rotation;

a center of gravity of said portable air moving device located within said lower half of said overall vertical length;

a vertically oriented elongate air outlet located within said upper portion of said elongate housing;

a high velocity exhaust air stream generated by said air blower assembly, wherein substantially all of said exhaust air stream exits said interior space via said vertically elongate air outlet as said high velocity exhaust air stream at an elevation above said air blower assembly; and an air passageway directly connecting an exhaust port of said blower assembly to said vertically oriented elongate air outlet, wherein said air passageway comprises an air directing component comprising an elongate curved member that directs said high velocity exhaust air stream from said blower assembly toward said vertically oriented elongate air outlet.

2. A portable air moving device that is free standing on a support surface, said device comprising:

a base for engaging said support surface;

an elongate housing coupled to said base having a longitudinal length extending substantially upward from said support surface;

said elongate housing defining an interior space;

an overall vertical length of said portable air moving device comprising:

an upper portion defined by the upper half of said overall vertical length;

a lower portion defined by a lower half of said overall vertical length;

at least one air inlet in said elongate housing allowing intake air to enter said interior space;

an air blower assembly disposed substantially within said lower portion of said overall vertical length and within said interior space, said air blower assembly comprising:

a motor;

an air impeller rotated about an axis of rotation by said motor;

a high velocity exhaust air stream generated by said air blower assembly;

a vertically oriented elongate air outlet located within said upper portion of said elongate housing allowing said high velocity exhaust air stream to exit said interior space;

an air directing component that directs said high velocity exhaust air stream from said blower assembly toward said vertically oriented elongate air outlet;

a maximum velocity of said high velocity exhaust air stream when measured about 8 feet from said air outlet;

a maximum thrust generated by said maximum velocity of said high velocity exhaust air stream in a direction substantially opposite to a direction of a flow of said high velocity exhaust air stream as said high velocity exhaust air stream exits said air outlet; and a velocity to thrust ratio, said velocity to thrust ratio being said maximum velocity of said exhaust air stream divided by said maximum thrust generated by said exhaust air stream, wherein said ratio is about 500:1 or greater.

3. The portable air moving device of claim 2, wherein said maximum thrust is about 1.0 pound of force or less.

4. The portable air moving device of claim 2, wherein said maximum velocity is about 500 feet per minute or greater.

5. The portable air moving device of claim 2, wherein said maximum velocity is within a range of about 750 feet per minute to about 2000 feet per minute.

6. The portable air moving device according to claim 2, wherein said exhaust air stream exits said air blower assembly through an exhaust port of said air blower assembly and enters an upper portion of said interior space of said elongate housing along a second flow path and exits said interior space through said air outlet along a third flow path.

7. The portable air moving device of claim 6, wherein said air blower assembly is oriented within said interior space of said elongate housing to position and direct said exhaust port substantially toward said air outlet directing said second flow path of said exhaust air stream substantially toward said air outlet.

8. The portable air moving device of claim 6, wherein said second flow path is substantially orthogonal to said third flow path.

9. The portable air moving device of claim 8, wherein said air directing component efficiently directs said exhaust air stream between said second flow path and said third flow path.

10. The portable air moving device of claim 9, wherein said air directing component further comprises a gradual and elongate curved surface that creates a substantially smooth transition between said second flow path and said third flow path of said exhaust air stream.

11. The portable air moving device of claim 9, wherein said air directing component is at least one of i) separate components disposed within said interior space, ii) an integral part of said elongate housing, or iii) an integral part of said air blower assembly.

12. The portable air moving device of claim 6, further comprising at least one air segregation wall dividing said interior space of said elongate housing into an intake portion and an exhaust portion to substantially prevent said exhaust air stream from mixing with said intake air within said interior space of said elongate housing, wherein said air segregation wall diverges outward and upward from said exhaust port toward said elongate housing.

13. The portable air moving device of claim 12, wherein said at least one air segregation wall is at least one of i) a separate component disposed within said interior space, ii) an integral part of said elongate housing, or iii) an integral part of said air blower assembly.

14. The portable air moving device of claim 6, wherein said intake air passes between said air inlet and said air blower assembly along a first flow path.

15. The portable air moving device of claim 14, wherein said first flow path is substantially orthogonal to said second flow path.

16. The portable air moving device of claim 14, wherein said first flow path is substantially orthogonal to said third flow path.

17. A portable air moving device that is free standing, said device comprising:

a base for engaging a support surface;

an elongate housing coupled to said base having a longitudinal length extending substantially upward from said base;

an interior space defined by said elongate housing;

an overall vertical length of said portable air moving device comprising:

an upper portion defined by the upper half of said overall vertical length;

a lower portion defined by a lower half of said overall vertical length;

at least one air inlet in said lower portion of said elongate housing allowing intake air to enter said interior space of said elongate housing;

an air blower assembly disposed within said interior space of said elongate housing, said air blower assembly comprising:

an impeller casing comprising:

an intake port;

an exhaust port, wherein said exhaust port comprises an exhaust port area defined by a major dimension oriented side to side and a minor dimension oriented front to back relative to said elongate housing;

an air impeller disposed in said impeller casing;

a motor for rotating said impeller about an axis of rotation;

wherein said air blower assembly generates a high velocity exhaust air stream;

a vertically oriented elongate air outlet in said elongate housing located within said upper portion allowing said exhaust air stream to exit said interior space of said elongate housing, wherein said air outlet comprises an air outlet area defined by a major dimension oriented top to bottom and a minor dimension oriented side to side relative to said elongate housing; and a first flow path of ambient air, wherein a rotating motion of said air impeller acts to draw said ambient air along said first flow path, through said air inlet and into said interior space of said elongate housing, said ambient air subsequently passing through said intake port and into said air blower assembly along said first flow path;

a second flow path comprising a high velocity exhaust air stream generated by rotating motion of said impeller, which accelerates said inlet air in said air blower assembly thereby generating said high velocity exhaust air stream, wherein said high velocity exhaust air stream exits said air blower assembly through said exhaust port of said impeller casing along said second flow path;

a transition area within said interior space of said elongate housing fluidly connecting said exhaust port of said air blower assembly in said lower portion of said elongate housing to said vertically oriented elongate air outlet in said upper portion of said elongate housing, wherein said transition area allows said high velocity exhaust air stream to change direction and orientation as said high velocity exhaust air stream flows from said exhaust port of said air blower assembly to said vertically oriented elongate air outlet in said elongate housing; and a third flow path comprising said high velocity exhaust air stream, said third flow path resultant of said change of direction and orientation of said high velocity exhaust air stream in said transition area, wherein substantially all of said high velocity exhaust air stream exits said interior space through said vertically oriented elongate air outlet along said third flow path;

wherein said transition area provides a smooth transition between said second flow path and said third flow path to effectively maintain said air flow velocity of said high velocity exhaust air stream.

18. The portable air moving device of claim 17, wherein said third flow path is oriented substantially parallel to said support surface and said second flow path is oriented substantially orthogonal to said third flow path and said first flow path is oriented substantially orthogonal to said second flow path.

19. The portable air moving device of claim 18, wherein said first flow path is substantially orthogonal to said third flow path.

20. The portable air moving device of claim 17, further comprising an air directing component disposed within said transition area of said elongate housing, wherein said air directing component comprises a gradual and elongate curved surface that creates said smooth transition between said second flow path and said third flow path.

21. The portable air moving device of claim 20, wherein said air directing component is at least one of i) separate components disposed within said housing, ii) an integral part of said elongate housing or iii) an integral part of said air blower assembly.

22. The portable air moving device of claim 17, further comprising one or more air segregation walls separating said interior space of said elongate housing into an intake portion and an exhaust portion to substantially prevent said exhaust air stream from mixing with said intake air within said elongate housing, said air segregation walls further comprising divergent walls extending upward and outward from said exhaust port of said air blower assembly to said elongate housing.

23. The portable air moving device of claim 22, wherein said one or more air segregation walls are at least one of i) separate components disposed within said housing, ii) an integral part of said elongate housing or iii) an integral part of said air blower assembly.

24. The portable air moving device of claim 17, wherein said air blower assembly is disposed substantially within said lower portion of said elongate housing.

25. The portable air moving device of claim 24, wherein said air blower assembly is located to orient said exhaust port substantially toward said air outlet and to direct said second flow path toward said air outlet.

26. The portable air moving device according to claim 17, further comprising a maximum velocity of said exhaust air stream measured about 8 feet from said air outlet wherein said maximum velocity is about 500 feet per minute or greater.

27. The portable air moving device according to claim 17, further comprising a maximum velocity of said exhaust air stream measured about 8 feet from said air outlet wherein said maximum velocity is within a range of about 750 feet per minute to about 2000 feet per minute.

28. The portable air moving device according to claim 17, further comprising a maximum thrust in a direction substantially opposite to a direction of the flow of said exhaust air stream as said exhaust air stream exits said air outlet, wherein said maximum thrust is about 1.0 pound of force or less.

29. The portable air moving device according to claim 17, further comprising a velocity to thrust ratio, wherein a maximum velocity of said exhaust air stream measured about 8 feet from said air outlet divided by a maximum thrust generated by said exhaust air stream in a direction substantially opposite to the direction of the flow of said exhaust air stream as it exits said air outlet is about 500:1 or greater.

30. The portable air moving device according to claim 2 or 17, wherein a longitudinal length of said elongate housing is substantially orthogonal to said axis of rotation of said impeller of said air blower assembly.

31. The portable air moving device of claim 30, further comprising an elongated aspect ratio of said elongate housing, wherein said elongate aspect ratio is defined by said longitudinal length being greater than a width of said elongate housing and said elongate aspect ratio is about 2 to 1 or greater.

32. The portable air moving device of claim 2 or 17, further comprising:

a front wall of said elongate housing;

said air outlet located in said front wall, wherein a height of said vertically elongated air outlet to a width of said vertically elongated air outlet is at least 1.5 to 1;

two sidewalls of said elongate housing;

said air inlet being two air inlets, one air inlet in each of said sidewalls;

wherein said vertically elongated air outlet is located at an elevation above each of said two air inlets such that a lower end of said vertically elongated air outlet is vertically above an upper end of each of said two air inlets and above said axis of rotation of said air impeller of said air blower assembly.

33. The portable air moving device of claim 32, wherein said air blower assembly further comprises two air intake ports and a center of said two air inlets and a center of said two air intake ports is located substantially concentric about opposing ends of said axis of rotation of said air impeller.

34. The portable air moving device according to claim 2 or 17, wherein said elongate housing rotates or oscillates about an axis of rotation with respect to said support surface.

35. The portable air moving device of claim 34, wherein said axis of said rotation of said elongate housing is substantially parallel to said longitudinal length of said elongate housing.

36. The portable air moving device of claim 34, further comprising a rotator mechanism for moving said elongate housing with respect to said support surface.

37. The portable air moving device of claim 36, wherein axis of rotation of said elongate housing is a substantially vertical axis of rotation.

38. The portable air moving device of claim 37, further comprising a rotatable coupling between said base and said elongate housing, wherein said elongate housing rotates with respect to said base.

39. The portable air moving device of claim 37, further comprising a pre-determined angular range of said rotating of said elongate housing, wherein said pre-determined angular range is between about 0 degrees and about 360 degrees.

40. The portable air moving device of claim 37, further comprising a pre-determined angular range of said rotating of said elongate housing, wherein said pre-determined angular range is between about 0 degrees and about 90 degrees.

41. The portable air moving device according to claim 2 or 17, wherein said base is a unitary part of said elongate housing.

42. The portable air moving device according to claim 2 or 17, wherein said base is rotatably coupled to said elongate housing.

43. The portable air moving device according to claim 2 or 17, wherein said base is detachably coupled to said elongate housing having an operating configuration in which said base is coupled to said elongate housing and a non-operating configuration in which said base is detached from said elongate housing.

44. The portable air moving device according to claim 2 or 17, further comprising a handle, wherein said handle is one of i) a separate part attached to said elongate housing or ii) an integral part of said elongate housing.

45. The portable air moving device according to claim 2 or 17, further comprising a control assembly for controlling a function of said device.

46. The portable air moving device of claim 45, wherein said motor further comprises a variable speed motor having one or more rotational speeds, and said control assembly controls said rotational speeds.

47. The portable air moving device according to claim 2 or 17, wherein said motor is a permanent split capacitor (PSC) motor.

48. The portable air moving device of claim 47, wherein said motor is a totally enclosed non-ventilated electric motor.

49. The portable air moving device according to claim 2 or 17, wherein said air blower assembly further comprises a centrifugal blower assembly.

50. The portable air moving device according to claim 2 or 17, wherein the distance from said impeller to a furthest extent of said air outlet is greater than a diameter of said air impeller.

51. The portable air moving device according to claim 2 or 17, further comprising a center of gravity of said portable air moving device wherein said center of gravity is within said lower portion of said portable air moving device.

52. The portable air moving device according to claim 2 or 17, further comprising an elongated aspect ratio of said elongate housing, wherein said elongate aspect ratio is defined by said longitudinal length being greater than a width of said elongate housing and said elongate aspect ratio is about 2 to 1 or greater.

53. A portable air moving device that is free standing, said device comprising:

an elongate housing having a longitudinal length extending substantially upward;

an upper portion defined by the upper half of said elongate housing;

a lower portion defined by a lower half of said elongate housing;

at least one air inlet in said lower portion of said elongate housing allowing intake air to enter said housing;

at least one air segregation wall within said elongate housing dividing an interior of said elongate housing into an intake portion and an exhaust portion;

an air blower assembly disposed within said lower portion of said elongate housing, said air blower assembly comprising:

an impeller casing having at least one intake port located within said intake portion of said interior of said housing and at least one exhaust port, wherein said exhaust port comprises an exhaust port area defined by a major dimension oriented substantially side to side and a minor dimension oriented substantially front to back of said elongate housing;

an air impeller rotatably disposed in said impeller casing;

a motor for rotating said impeller about an axis of rotation;

a high velocity exhaust air stream generated by said air blower assembly and passing through said exhaust port of said air blower assembly;

an expansion area in said exhaust portion of said interior of said elongate housing located downstream of and in fluid communication with said impeller casing exhaust port;

an elongate air outlet in said elongate housing located substantially within said upper portion of said elongate housing and in fluid communication with said expansion area, wherein said elongate air outlet comprises an air outlet area defined by a major dimension oriented substantially top to bottom and a minor dimension oriented substantially side to side of said elongate housing;

a second flow path defined by said high velocity exhaust air stream exiting said at least one exhaust port of said impeller casing, said second flow path comprising a major dimension oriented substantially side to side and a minor dimension oriented front to back of said elongate housing as said second flow path exits said exhaust port of said impeller casing; and a third flow path defined by said high velocity exhaust air stream discharging from said elongate air outlet of said elongate housing, said third flow path comprising a major dimension oriented substantially top to bottom and a minor dimension oriented substantially side to side of said elongate housing as said third flow path exits said elongate air outlet of said elongate housing.

54. The portable air moving device of claim 53, further comprising a curved air directing component disposed within said expansion area in said interior of said housing for efficiently directing said exhaust air stream between said second flow path and said third flow path, wherein said curved air directing component creates a substantially smooth transition between said second flow path and said third flow path.

55. The portable air moving device of claim 53, further comprising:

a first column of high velocity exhaust air stream flowing through said exhaust port area of said impeller casing exhaust port and along said second flow path; and a second column of high velocity exhaust air stream flowing through said elongate air outlet in said elongate housing and along said third flow path;

wherein said second column of high velocity exhaust air stream is substantially orthogonal to and twisted relative to said first column of high velocity exhaust air stream.

56. The portable air moving device according to claim 17 or 53, wherein said exhaust air stream changes direction and orientation between said second flow path and said third flow path, said changes conforming to said major and said minor dimensions of said exhaust port and said air outlet.

57. The portable air moving device according to claim 17 or 53, wherein said impeller casing is unitary with said elongate housing.

58. The portable air moving device according to claim 2, 17 or 53, further comprising:

an inlet opening area defined by said air inlet in said elongate housing; and an outlet opening area defined by said air outlet in said elongate housing;

wherein said outlet opening area is equal to or less than said inlet opening area.

59. The portable air moving device of claim 2, further comprising:

an inlet opening area of said air inlet;

an outlet opening area of said vertically oriented elongate air outlet; and a ratio of said outlet area to said inlet area, wherein said outlet opening area is less than said inlet opening area.

60. The portable air moving device of claim 17, further comprising:

a dimensional twist of said high velocity exhaust air stream as said high velocity exhaust air stream transitions between said second flow path and said third flow path, said dimensional twist comprising:

a minor dimension of a flow area of said high velocity exhaust air stream in said second flow path proximate said exhaust port of said air blower assembly, said minor dimension oriented front to back relative to said elongate housing as said high velocity exhaust air stream exits said exhaust port of said impeller casing; and a re-orienting of said minor dimension of said flow area of said high velocity exhaust air stream in said third flow path proximate said vertically oriented elongate air outlet, said re-oriented minor dimension oriented side to side relative to said elongate housing as said high velocity exhaust air stream exits said third flow path.

61. A portable air moving device that is free standing on a support surface, said device comprising:

a base for engaging said support surface;

an elongate housing having a longitudinal length extending substantially upward from said base;

an interior space defined by said elongate housing;

an overall vertical length of said portable air moving device comprising:

an upper portion defined by the upper half of said overall vertical length;

a lower portion defined by a lower half of said overall vertical length;

at least one air inlet in said elongate housing allowing intake air to enter said interior space;

an air blower assembly disposed substantially within said lower portion of said overall vertical length and within said interior space, said air blower assembly comprising:

an air impeller;

a motor for rotating said air impeller about an axis of rotation;

a center of gravity of said portable air moving device located within said lower half of said overall vertical length;

a vertically oriented elongate air outlet located within said upper portion of said elongate housing;

a high velocity exhaust air stream generated by said air blower assembly, wherein substantially all of said exhaust air stream exits said interior space via said vertically elongate air outlet as said high velocity exhaust air stream at an elevation above said air blower assembly;

an air passageway directly connecting an exhaust port of said blower assembly to said vertically oriented elongate air outlet, wherein said air passageway comprises an air directing component comprising an elongate curved member that directs said high velocity exhaust air stream from said blower assembly toward said vertically oriented elongate air outlet; and a velocity to thrust ratio, wherein a maximum velocity of said exhaust air stream measured about 8 feet from said air outlet divided by a maximum thrust generated by said exhaust air stream in a direction substantially opposite to the direction of the flow of said exhaust air stream as it exits said air outlet is about 500:1 or greater.

* * * * *